United States Patent [19]

Morita et al.

[11] 4,434,749

[45] Mar. 6, 1984

[54] COOLING SYSTEM FOR LIQUID-COOLED INTERNAL COMBUSTION ENGINES

[75] Inventors: Yasuyuki Morita; Katsuhiko Yokooku; Hideo Shiraishi; Masahiko Matsuura, all of Hiroshima, Japan

[73] Assignee: Toyo Kogyo Co., Ltd., Hiroshima, Japan

[21] Appl. No.: 361,340

[22] Filed: Mar. 24, 1982

[30] Foreign Application Priority Data

Mar. 25, 1981 [JP] Japan ..... 56-44471
Mar. 27, 1981 [JP] Japan ..... 56-45740

[51] Int. Cl.[3] ..... F01P 7/16
[52] U.S. Cl. ..... 123/41.02; 123/41.44; 123/41.72
[58] Field of Search ..... 123/41.44, 41.45, 41.46, 123/41.47, 41.02, 41.72

[56] References Cited

U.S. PATENT DOCUMENTS 1,787,562 1/1931 Barlow ..... 123/41.44
3,999,598 12/1976 Fehr et al. ..... 123/41.44

FOREIGN PATENT DOCUMENTS 3007640 9/1981 Fed. Rep. of Germany ... 123/41.44
53-136144 11/1978 Japan .
55-35167 3/1980 Japan .

*Primary Examiner*—William A. Cuchlinski, Jr.
*Attorney, Agent, or Firm*—Fleit, Jacobson, Cohn & Price

[57] ABSTRACT

Engine cooling system including a cooling water passage having cooling water jackets formed in the engine and a water pump for circulating cooling water through the water passage. A driving motor is provided for driving the water pump and a control circuit for the motor receives an engine speed signal so that the speed of the water pump is decreased to a predetermined low level when the engine temperature is low so that the engine can be warmed up rapidly while maintaining a cooling water circulation for preventing local overheating of the engine.

6 Claims, 10 Drawing Figures

FIG. 1
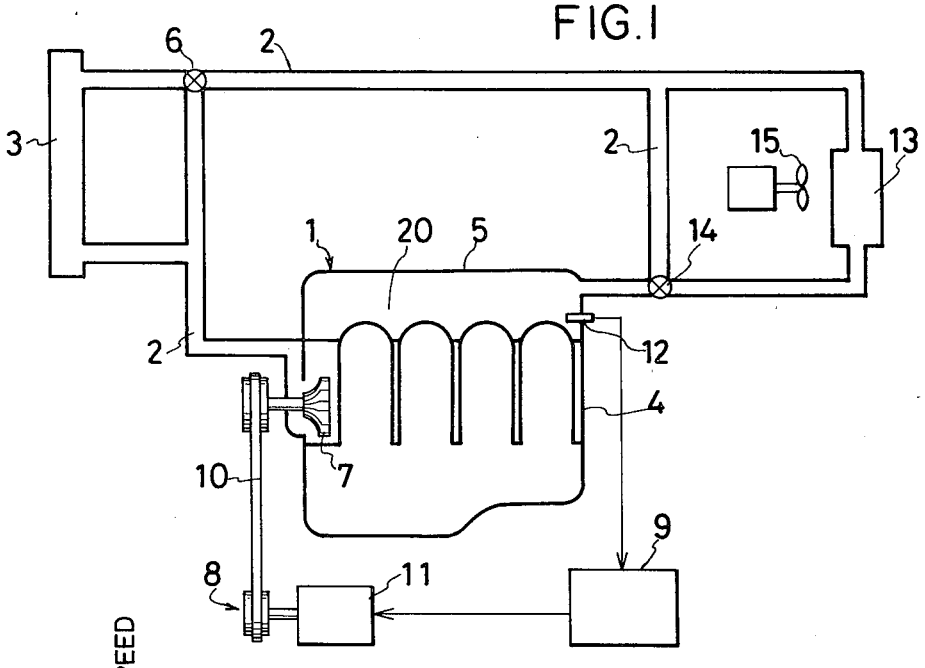
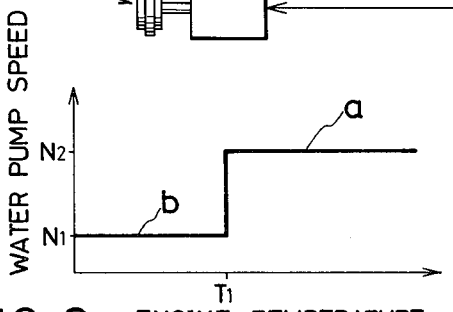
FIG. 2
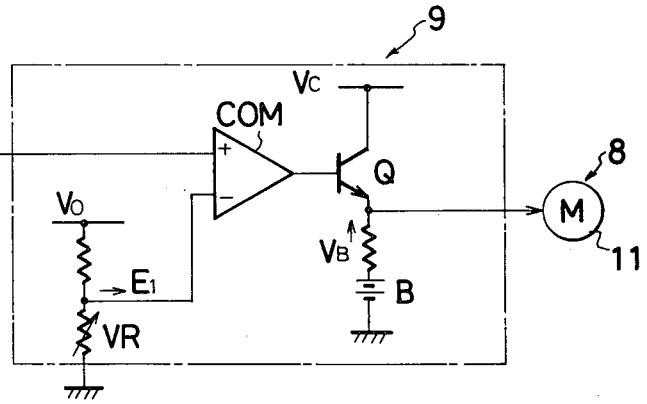
FIG. 3

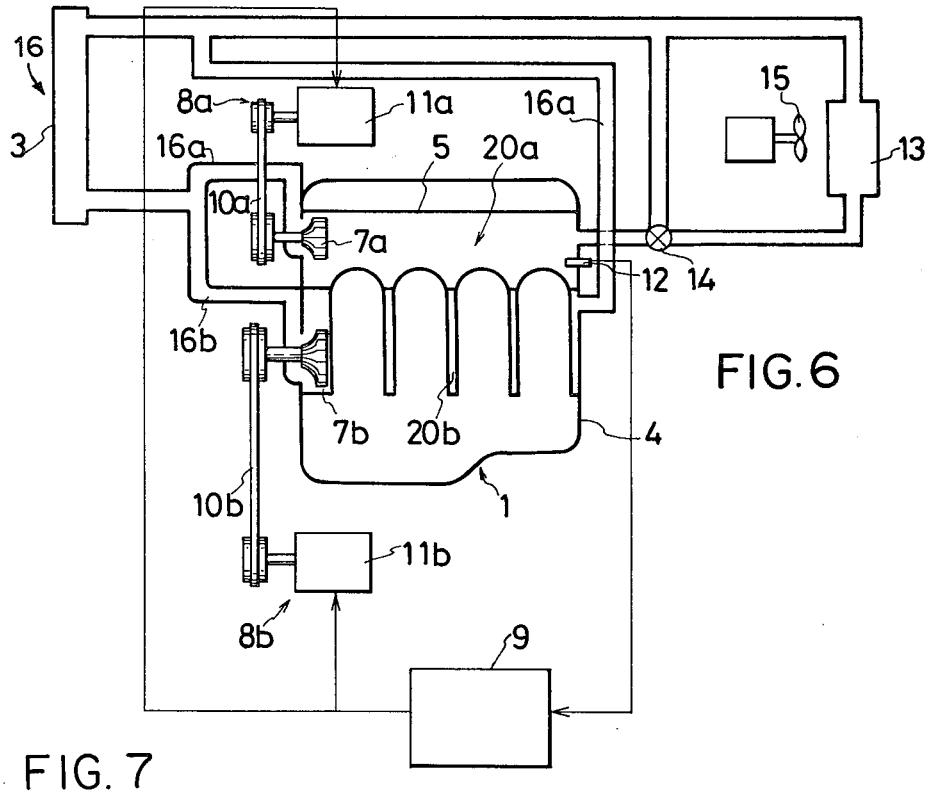
FIG. 6
FIG. 7
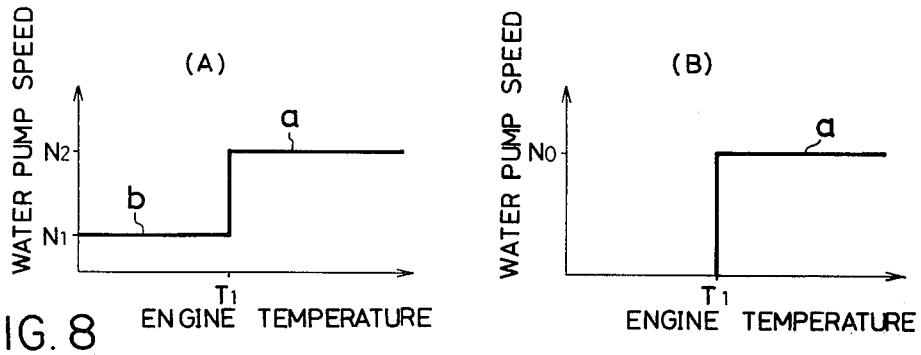
FIG. 8
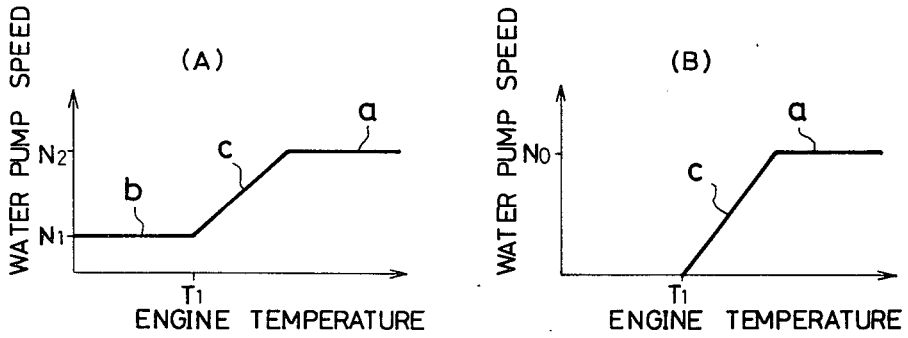

COOLING SYSTEM FOR LIQUID-COOLED INTERNAL COMBUSTION ENGINES

The present invention relates to a cooling system for a liquid-cooled internal combustion engine, and more particularly to a control for cooling medium feed pump means.

Conventional liquid-cooled engines have cooling liquid jackets formed in the cylinder blocks and the cylinder heads, and pumps are provided for circulating the cooling medium through the jackets. Such cooling medium feed pumps are conventionally connected through belt-pulley mechanisms with the engine crankshafts so that the pumps are continuously driven by the engine crankshafts to thereby circulate the cooling medium through the jackets. The capacities of the pumps are determined so that a sufficient amount of cooling medium is circulated to provide a satisfactory cooling capacity even under a hot weather and a heavy duty operation. Therefore, there is a problem that, when the engine is operated in a very cold atmosphere and the engine speed is low, a substantially increased time is required for warming up the engine due to an excessive cooling. Further, since the cooling medium feeding pump is unnecessarily driven even under a cold operation, there will be a noticeable energy loss which leads to a poor fuel economy.

In Japanese patent application No. 52-49910 filed on May 2, 1977 and disclosed for public inspection on Nov. 28, 1978 under the public disclosure number of 53-136144, there is proposed to provide a clutch in the pump driving belt-pulley mechanism so that the clutch is disengaged when the engine cooling medium temperature is below a predetermined value. According to this proposal, the engine can be relieved of driving effort under a cold engine temperature so that it can be warmed up quickly and any energy loss due to the unnecessary driving of the engine can successfully be eliminated.

Further, Japanese patent application No. 53-108611 filed on Sept. 6, 1978 and disclosed for public inspection under the disclosure number of 55-35167 proposes to provide clutches in the driving mechanism for the cooling medium circulating pump as well as in the driving mechanism for the radiator cooling fan so that the pump and the fan can be stopped under a cold engine operation. The proposed mechanisms are not however recommendable because the engine may be subjected to a thermal shock when the cluch or clutches are engaged to transmit driving torque to the pump and the fan and a substantial amount of cooling medium is started to circulate. Further, the engine may have a further problem of local overheat if the cooling medium pump is completely stopped and the cooling medium is circulated only under a natural convection. In fact, the cylinder head temperature rises very quickly particularly in the vicinity of the combustion chamber and those areas close to the exhaust ports may become overheat conditions even when the overall engine temperature is below a predetermined value.

It is therefore an object of the present invention to provide an engine cooling system in which unnecessary driving effort for the cooling medium pump can be eliminated under a low engine temperature condition and engine warming up can be accelerated without danger of local overheating.

Another object of the present invention is to provide a device for controlling the operation of the engine cooling medium pump, by which the pump can be operated independently from the engine.

According to the present invention, the above and other objects can be accomplished by a cooling system for a liquid-cooled internal combustion engine comprising cooling liquid passage means having cooling liquid jacket means provided in the engine for passing cooling liquid therethrough, cooling liquid pump means provided in said passage means for circulating the cooling liquid through said passage means and said jacket means, driving means for driving said pump means, engine temperature sensing means for sensing engine temperature and producing an engine temperature signal, control means adapted to receive the engine temperature signal and control said driving means so that operating speed of the pump means is decreased, when the engine temperature is below a first predetermined value, to a predetermined low speed which is lower than a normal operating speed. The speed of the pump means may be abruptly decreased at the predetermined engine temperature but in a preferable embodiment the pump speed is gradually changed.

It is further preferable in the present invention to separate the cooling liquid jacket means in the hot zone of the engine from the jacket means in the cold zone of the engine and separate pump means be provided to feed the cooling liquid to the jacket means in the engine hot zone and to the jacket means in the engine cold zone. The pump means for the hot zone may then be operated with a low speed under a cold engine state to maintain a certain amount of cooling liquid circulation but the pump means for the cold zone may be completely stopped.

The above and other objects and features of the present invention will become apparent from the following descriptions of preferred embodiments taking reference to the accompanying drawings, in which:

FIG. 1 is a diagrammatical view of an engine having a cooling system in accordance with one embodiment of the present invention;

FIG. 2 is a diagram showing the water pump control in the embodiment shown in FIG. 1;

FIG. 3 is a diagram showing the circuit for performing the control shown in FIG. 2;

FIG. 6 is a diagrammatical view of an engine similar to FIG. 1 but showing another embodiment;

Figure 4:
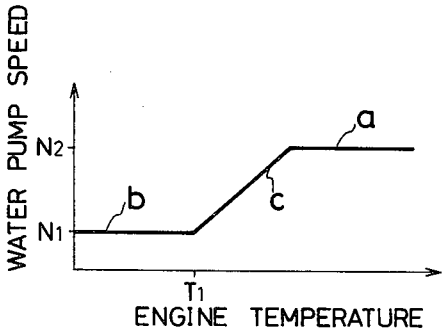
FIG. 4 is a diagram similar to FIG. 2 but showing another mode of the water pump control.

FIGS. 7(A) and (B) are diagrams showing an example of control of the water pumps in the embodiment shown in FIG. 6; and FIGS. 8(A) and (B) are diagrams similar to FIGS. 7(A) and (B) respectively but showing another example of control.

Referring now to the drawings, particularly to FIG. 1, there is shown an engine 1 having a cooling water passage 2 provided with a radiator 3. The engine 1 includes a cylinder block 4 and a cylinder head 5 which is formed with cooling water jackets 20 forming parts of the cooling water passage 2 as well known in the art. In the water passage 2, there is provided a thermostatic valve 6 which controls the flow of water through the radiator 3 in accordance with the water temperature.

The engine 1 is further provided with a water pump 7 which is disposed in the cooling water passage 2 for circulating the cooling water through the passage 2. The pump 7 is drivingly connected with a variable speed motor 11 through a belt-pulley type driving mechanism 8 including a driving belt 10 so that the pump 7 is driven by the motor 11. A controller 9 is provided for controlling the operation of the motor 11. The controller 9 is connected with the output of an engine temperature sensor 12 so that it controls the speed of the motor 11 in accordance with the engine temperature. The temperature sensor 12 is located preferably at a high temperature portion such as the cylinder head of the engine 1.

As shown in FIG. 1, the cooling water passage 2 is further provided with a heat exchanger 13 for a room heater. A blower fan 15 is provided for blowing air through the heat exchanger 13 to the room (not shown). In the water passage 2, there is provided a control valve 14 for controlling the water flow to the heat exchanger 13.

Referring now to FIG. 3, it will be noted that the controller 9 includes a switching transistor Q which has an emitter connected with the motor 11. The collector of the transistor Q is connected with the line voltage Vc. A lower voltage source B is also connected with the motor 11. The base of the transistor Q is connected with the output of a comparator COM which has a positive input terminal connected with the output of the engine temperature sensor 12 and a negative input terminal connected with a voltage divider having a voltage divider VR so that a reference voltage $E_1$ is applied thereto.

It will therefore be understood that when the engine is operated under a normal temperature such as a temperature higher than $T_1$ in FIG. 2, the output voltage of the engine temperature sensor 12 is higher than the reference voltage $E_1$ so that a high level signal is produced at the output of the comparator COM. Therefore, the transistor Q is turned on and the line voltage $V_C$ is applied to the motor 11. The motor 11 and therefore the pump 7 are operated at a higher normal speed $N_2$ as shown by a line a in FIG. 2. The amount of water circulated through the water passage 2 is therefore maintained at a high level to provide a satisfactory cooling. When the engine temperature is lower than the reference value $T_1$, the output voltage of the sensor 12 is lower than the reference voltage $E_1$ so that a low level signal is produced at the output of the comparator COM. Thus, the transistor Q is turned off and the motor 11 is supplied with a power from the lower voltage source B. Therefore, the speed of the motor 11 is decreased and the pump 7 is driven at a lower speed $N_1$ as shown by a line b in FIG. 2. The amount of water circulation is therefore decreased so that the engine 1 can be rapidly warmed up. Since a certain amount of water circulation is maintained, it is possible to prevent local overheating.

Figure 5:
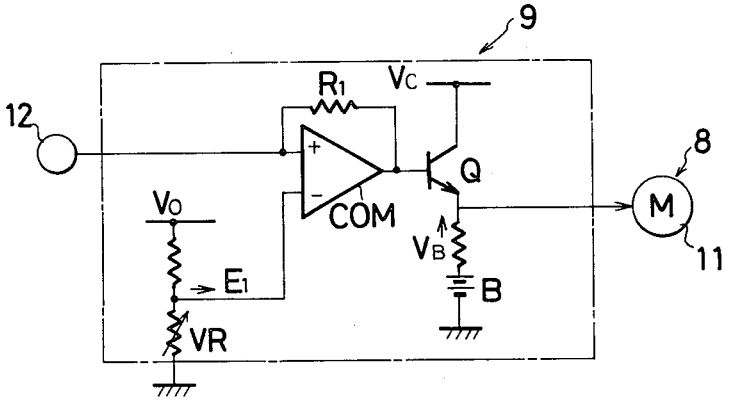
FIG. 5 is a circuit diagram showing the control circuit for performing the control shown in FIG. 4.

Referring now to FIG. 5, it will be noted that the circuit shown therein is different from that shown in FIG. 3 in that a feedback resistor $R_1$ is provided between the output terminal and the positive input terminal of the comparator COM. Therefore, the motor speed and the pump speed is changed gradually from the minimum speed $N_1$ to the normal speed $N_2$ as the engine temperature increased beyond the reference value $T_1$ as shown by a line c in FIG. 4.

Referring now to FIG. 6, the engine 1 shown therein has a cooling water passage 16 which is separated into two branch passages **16*a* and 16*b*. The passage 16*a* has water jackets 20*a* formed in the cylinder head 5 which is a high temperature portion of the engine. The passage 16*b* has water jackets 20*b* formed in the cylinder block 4 which is a low temperature portion of the engine. In the passages 16*a* and 16*b*, there are respectively provided water pumps 7*a* and 7*b* which are connected with driving motors 11*a* and 11*b*, respectively, through driving mechanisms 8*a* and 8*b* including driving belts 10*a* and 10*b*. The motors 11*a* and 11*b* are controlled by means of a controller 9 which receives an engine temperature signal from a sensor 12**.

The motor **11*a* is controlled by a circuit similar to that shown in FIG. 3 so that the speed of the pump 7*a* is changed between the speeds $N_1$ and $N_2$ as shown in FIG. 7(A) in accordance with the engine temperature. Alternatively, the motor 11*a* controlled by a circuit similar to that shown in FIG. 5 so that the speed of the pump 7*a* is changed gradually between the speeds $N_1$ and $N_2$ as shown in FIG. 8(A). The motor 11*b* is controlled by a circuit similar to that shown in FIG. 3 except that the lower voltage source B is omitted. Thus, the motor 11*b* and the pump 7*b* are stopped with an engine temperature lower than the reference value $T_1$ as shown in FIGS. 7(B) and 8(B). In this embodiment, water circulation is maintained only through the jackets in the cylinder head 5** which is the high temperature portion of the engine to thereby prevent local overheating during a warming up period.

The invention has thus been shown and described with reference to specific embodiments, however, it should be noted that the invention is in no way limited to the details of the illustrated arrangements but changes and modifications may be made without departing from the scope of the appended claims.

We claim:

1. A cooling system for a liquid-cooled internal combustion engine comprising cooling liquid passage means having cooling liquid jacket means provided in the engine for passing cooling liquid therethrough, cooling liquid pump means provided in said passage means for circulating the cooling liquid through said passage means and said jacket means, electrically operated driving motor means for driving said pump means so that the total amount of the cooling liquid circulated through the passage means and the jacket means is pumped by said pump means, engine temperature sensing means for sensing engine temperature and producing an engine temperature signal, control means adapted to receive the engine temperature signal and control said driving means so that the operating speed of the pump means is decreased, when the engine temperature is below a first predetermined value, to a predetermined low speed which is lower than a normal operating speed.

2. A cooling system in accordance with claim 1 in which said control means includes means for increasing the operating speed of the pump means gradually as the engine temperature increases beyond the first predetermined value.

3. A cooling system in in accordance with claim 2 in which said control means includes means for maintaining the operating speed of the pump means substantially constant when the engine temperature is above a second predetermined value which is higher than the first predetermined value.

4. A cooling system in accordance with claim 1 in which said sensing means is located in a high temperature portion of the engine.

5. A cooling system in accordance with claim 1 in which said control means includes means for providing a reference signal and means for comparing the engine temperature signal with said reference signal to provide an output signal for controlling said driving means.

6. A cooling system in accordance with claim 5 in which said control means includes means for feeding back said output signal of the comparing means to said engine temperature signal so that the operating speed of the pump means is gradually increased as the engine temperature increases beyond the first predetermined value.

* * * * *